US009456270B2

(12) United States Patent
Porjo et al.

(10) Patent No.: US 9,456,270 B2
(45) Date of Patent: Sep. 27, 2016

(54) HEADSET APPARATUS REGISTERING MOVEMENT IN THE HOUSING

(75) Inventors: Niko Santeri Porjo, Kaarina (FI); Jakke Sakari Makela, Turku (FI)

(73) Assignee: Nokia Technologies Oy, Espoo (FI)

( * ) Notice: Subject to any disclaimer, the term of this patent is extended or adjusted under 35 U.S.C. 154(b) by 113 days.

(21) Appl. No.: 14/349,053

(22) PCT Filed: Oct. 5, 2011

(86) PCT No.: PCT/IB2011/054394

§ 371 (c)(1),
(2), (4) Date: Jul. 13, 2014

(87) PCT Pub. No.: WO2013/050804

PCT Pub. Date: Apr. 11, 2013

(65) Prior Publication Data

US 2014/0363004 A1 Dec. 11, 2014

(51) Int. Cl.

| | |
|---|---|
| ***H04R 1/10*** | (2006.01) |
| ***H04R 1/08*** | (2006.01) |
| ***H04R 1/28*** | (2006.01) |

(52) U.S. Cl.

CPC ..... *H04R 1/1091* (2013.01); *H04R 1/08* (2013.01); *H04R 1/1041* (2013.01); *H04R 1/28* (2013.01); *H04R 2430/00* (2013.01)

(58) Field of Classification Search

None

See application file for complete search history.

(56) References Cited

U.S. PATENT DOCUMENTS

| | | | | |
|---|---|---|---|---|
| 4,644,581 | A * | 2/1987 | Sapiejewski | H04R 1/1083 381/372 |
| 4,928,311 | A | 5/1990 | Trompler | |
| 7,853,034 | B1 * | 12/2010 | Gresko | H04R 1/1058 381/370 |
| 2002/0085733 | A1 | 7/2002 | Cottrell | |
| 2006/0029234 | A1 | 2/2006 | Sargaison | |
| 2008/0292111 | A1 * | 11/2008 | Park | H04R 1/1041 381/71.6 |
| 2009/0005129 | A1 | 1/2009 | McLoone et al. | |
| 2009/0010474 | A1 | 1/2009 | Ouryouji | |
| 2011/0243345 | A1 * | 10/2011 | Carreras | G10L 21/0208 381/71.6 |

FOREIGN PATENT DOCUMENTS

| | | |
|---|---|---|
| EP | 0208389 | 1/1987 |
| EP | 1675429 | 6/2006 |
| WO | 0167805 | 9/2001 |

OTHER PUBLICATIONS

International Search Report and Written Opinion received for corresponding Patent Cooperation Treaty Application No. PCT/IB2011/054394, dated Aug. 22, 2012, 19 pages.

* cited by examiner

*Primary Examiner* — Brenda Bernardi

(74) *Attorney, Agent, or Firm* — Alston & Bird LLP

(57) ABSTRACT

An apparatus comprising: a housing containing a speaker for delivering sound waves; and a sensing element for detecting air movement in the housing and further providing a control signal based on the detected air movement. The control signal is sent to a host apparatus. A user interface operation dependent on the control signal is preformed, such as filtering, muting or amplifying an input audio signal to the speaker or switching off the host apparatus. The housing comprises compressible material such that when the compressible material is displaced air movement in the housing is detected by the sensing element.

26 Claims, 7 Drawing Sheets

HEADSET APPARATUS REGISTERING MOVEMENT IN THE HOUSING

RELATED APPLICATION

This application was originally filed as PCT Application No. PCT/IB2011/054394 filed Oct. 5, 2011.

FIELD OF THE APPLICATION

The present application relates to a method and apparatus for providing an acoustic signal. In some embodiments the method and apparatus for providing an acoustic signal relating to headsets.

BACKGROUND OF THE APPLICATION

Apparatus which provide acoustic signals, such as headsets are well known. When such apparatus are used the headsets are located adjacent to or within a user's outer ear so that the acoustic signal provided by the headset may be provided directly into the ear canal of the ear. There are different types of headsets available. For example some headsets are configured to fit inside the ear canal of a user while others are configured to fit adjacent to the ear canal. It is known that some headsets seal the entrance of the outer ear canal effectively to maximise the user's ability to hear sound waves that are substantially isolated from ambient interferences.

Headsets in use can transmit loud noises, audible pops or other undesirable sounds to the user's eardrum caused by the conduction of sounds when the casing or support structure is touched or scratched. The audible effect of such undesirable sounds can be more severe on some users than others. For example, some users may suffer from tinnitus or hyperacusis. Alternatively, some users may have a more sensitive hearing mechanism. It is known that sudden changes in audio levels can also occur due to the sound source, for example, a sound source could have been recorded at high sound pressure levels or such recording could comprise discomforting loud noises and transients. This is particularly true if the sounds have been digitally created or edited. Available solutions do not offer an instant controlling mechanism where playback levels could be attenuated without requiring any significant effort or complex mechanisms.

SUMMARY OF SOME EMBODIMENTS

According to a first aspect of the application there is provided an apparatus comprising: a housing containing a speaker for delivering sound waves; and a sensing element for detecting air movement in the housing and further providing a control signal based on the detected air movement.

The apparatus may further be configured to send the control signal to a host apparatus.

The apparatus may be further configured to perform a user interface operation dependent on the control signal.

The apparatus may further comprise a controller configured to receive the control signal and perform a user interface operation.

The user interface operation may comprise at least one of: filtering an input audio signal for the speaker; muting an input audio signal for the speaker; switching off a host apparatus; and amplifying an input audio signal for the speaker.

The housing may further comprise at least a first portion configured with a compressible material, where the compressible material is coupled to the sensing element such that when the compressible material is displaced air movement in the housing is detected by the sensing element.

The housing may be at least partially constructed from a high density foam configured to provide passive attenuation of sound from the surrounding environment The housing may comprise a first cavity wherein the sensing element is located within the first cavity and configured to detect air movement in the first cavity.

The first cavity may define a compressible air volume, such that when compressed the change in air volume creates air movement in the first cavity.

The housing may comprise at least one further cavity coupled to the first cavity, wherein the at least one further cavity defines a compressible air volume which when compressed creates air movement in the first cavity.

The housing may further comprise a leakage conduit is configured to couple the first cavity to the exterior of the apparatus.

The first cavity may be configured to generate turbulent air flow movement.

The sensing element may be configured to determine at least one of: a direction of the air movement in the housing; and a speed of the air movement in the housing.

The housing may be configured so as to generate at least a partial seal against a surface.

The sensing element may comprise at least one of: a microphone; a heated wire and temperature sensor; a cantilever; and a micro-electro-mechanical system.

The apparatus may comprise at least one of: headphones; headset; earphones; earbuds; and earcups.

A portable electronic device may comprise the apparatus as discussed herein.

The compressible material may be packing foam.

The high density foam may comprise Kaiflex.

According to a second aspect there is provided a method comprising: providing a housing containing a speaker for delivering sound waves; detecting air movement in the housing; and providing a control signal based on the detected air movement.

The method may further comprise sending the control signal to a host apparatus.

The method may further comprise performing a user interface operation dependent on the control signal.

The method may further comprise receiving the control signal at a controller configured to perform the user interface operation.

Performing the user interface operation may comprise at least one of: filtering an input audio signal for the speaker; muting an input audio signal for the speaker; switching off a host apparatus; and amplifying an input audio signal for the speaker.

The housing may further comprise at least a first portion configured with a compressible material, the method comprising coupling the compressible material to the sensing element such that when the compressible material is displaced air movement in the housing is detected by the sensing element.

The method may further comprise providing passive attenuation of sound from the surrounding environment by the housing configured to be at least partially constructed from a high density foam.

The method may further comprise: providing a first cavity within the housing; locating the sensing element within the first cavity; and detecting air movement in the first cavity.

The method may further comprise defining a compressible air volume by first cavity, such that when compressed the change in air volume creates air movement in the first cavity.

The method may further comprise providing at least one further cavity coupled to the first cavity, wherein the at least one further cavity defines a compressible air volume which when compressed creates air movement in the first cavity.

The method may further comprise providing a leakage conduit configured to couple the first cavity to the exterior of the apparatus.

The first cavity may be configured to generate turbulent air flow movement.

Detecting air movement in the housing may comprise at least one of: determining the direction of the air movement in the housing; and determining the speed of the air movement in the housing.

The method may further comprise generating at least a partial seal against a surface with the housing.

Detecting air movement in the housing may be performed by at least one of: a microphone; a heated wire and temperature sensor; a cantilever; and a microelectro-mechanical system.

According to a third aspect there is provided an apparatus comprising: housing means for containing a speaker for delivering sound waves; means for detecting air movement in the housing means; and means for providing a control signal based on the detected air movement.

BRIEF DESCRIPTION OF DRAWINGS

For a better understanding of the present application and as to how the same may be carried into effect, reference will now be made by way of example to the accompanying drawings in which.

SOME EMBODIMENTS OF THE APPLICATION

In the following exemplifying embodiments are explained with reference to a pair of headphones or headset. However it would be understood that embodiments of the application can be applied to any suitable earpiece or headphone configuration. Before explaining in detail the certain exemplifying embodiments, an example of a set (or pair) of headphones are briefly explained with reference to FIG. 1 to assist in understanding the herein described embodiments.

Figure 1:
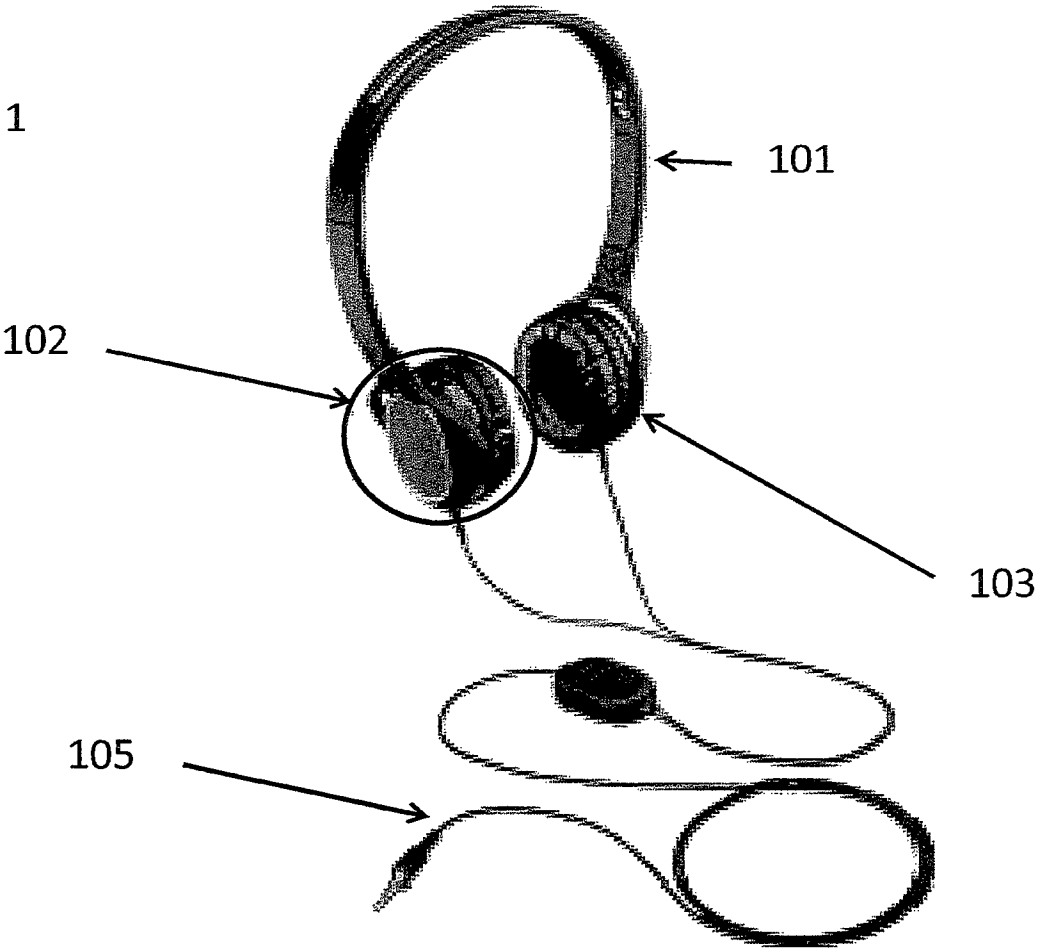
FIG. 1 illustrates a schematic view of apparatus suitable for implementing some embodiments of the application.

With respect to FIG. 1 an ear worn speaker apparatus in the form of a set of supra-aural headphones are shown. Supra-aural headphones are designed to have pads with sit on top of the ears rather than around them. However ear worn speaker apparatus can be cup-type (circumaural) which are designed to have pads which surround the ears, earphones or earbuds which are designed to have pads or buds which are located at least partially within the ear and in-ear or canal-phones which are located substantially within the ear canal. Furthermore ear worn speakers can be closed where the back of the earcup/earbud is closed to the environment, or open, where the front of the earcup/earbud is open to the environment.

Furthermore it would be understood that the ear worn speaker apparatus shown in FIG. 1 and furthermore described with respect to embodiments of the application can further have noise cancellation electronics.

Furthermore although the following examples describe a headphone configuration it would be understood that similar embodiments can be implemented as headsets (where a microphone is provide to provide an audio input as well as the headphones providing an audio output).

Similarly it would be understood that the following description can be implemented for stereo and mono headsets and furthermore for single ear headphone/headset/earphone/earbud configurations where only one transducer is used.

With respect to FIG. 1 a typical ear worn speaker apparatus in the form of a set of supra-aural headphones are shown. The headphones 101 comprise a first earpiece or earcup 102 which can be placed over one ear, a second earpiece or earcup 103 which can be placed over the other ear and a headband support structure 101 configured to mechanically couple and support the first earcup 102 and second earcup 103. In the example shown in FIG. 1 the headband support structure 101 is further configured to mechanically bias the earcups in such a manner that the earcups are located firmly against the ear. The mechanical biasing means can be any suitable means such as for example spring or resilient material structure.

Although the example shown in FIG. 1, and furthermore the embodiments of the application as described with respect to FIGS. 2 to 5 show an ear worn speaker headphone set where the headband support structure is an over the head headband any suitable means of supporting or locating the earcups to the user's ear can be implemented in embodiments of the application. Furthermore it would be understood that in some embodiments the earbuds may be located within or on the ear at least partially by friction between the earbud and the ear of the user.

The first earcup 102 and second earcup 103 furthermore are shown to have an electrical cable 105 or coupling which is configured to couple the ear worn speaker set to a suitable electrical device or apparatus suitable for supplying electrical audio signals. In the embodiments described herein the electrical device or apparatus can also be called the host device.

As shown in FIG. 1 in some embodiments the electrical cable 105 can at one end comprise a plug to fit a suitable socket in the host device not shown.

Furthermore in some embodiments as shown in FIG. 1 the electrical cable 105 comprises an in-line volume control arrangement.

The earcups 102, 103 of the ear worn speaker set shown in FIG. 1 are constructed with a 'hard' plastic outer casing. These outer casings can transmit loud noises, audible pops or other undesirable sounds to the user's eardrum caused by the conduction of sounds when the casing or support structure is interfered. The audible effect of such undesirable sounds can be more severe on some users than others.

Figure 2:
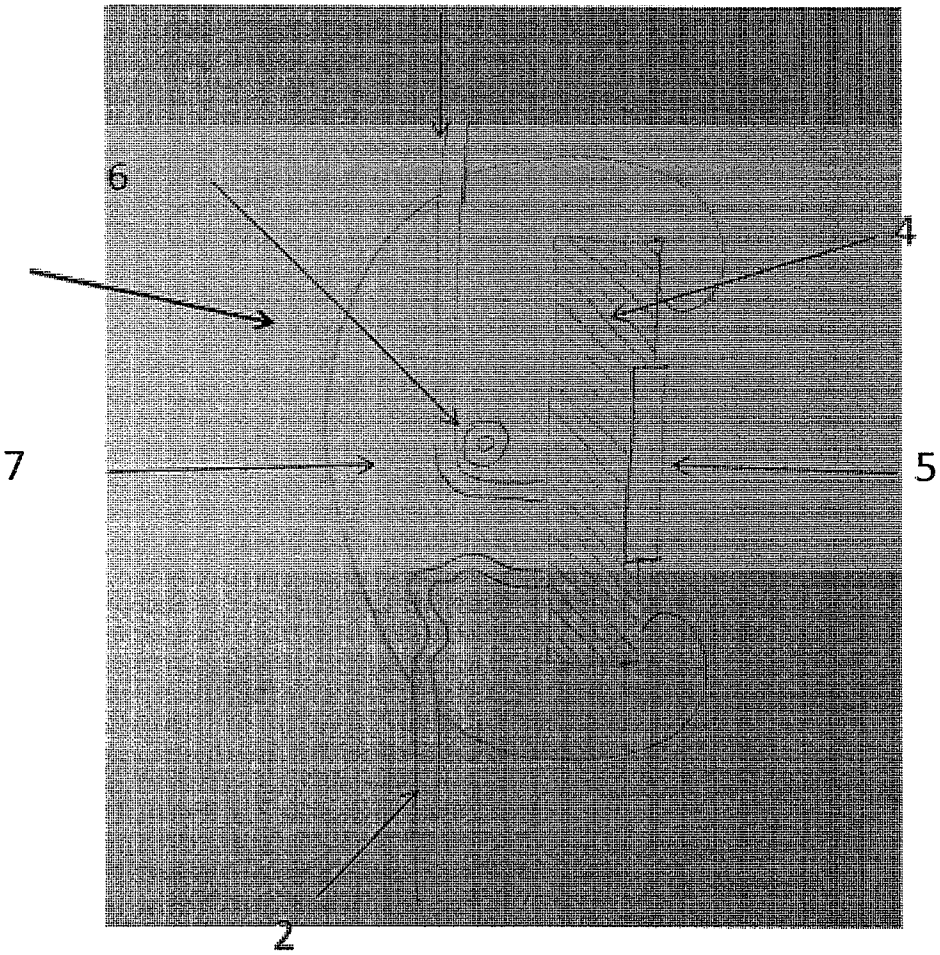
FIG. 2 illustrates a schematic side elevation cross sectional view of a headphone earcup arrangement suitable for implementing some embodiments of the application.

With respect to FIG. 2 a side elevation cross sectional view headphone earcup 1 according to some embodiments is shown. The headphone earcup 1 form is configured in this example to be that similar to the form of a convention supra-aural earcup. However it would be appreciated that in some embodiments the form and shape of the earcup can be any suitable shape. Furthermore it would be understood that embodiments of the application can be made in the form of earpieces and/or earbuds of any suitable shape and form.

The headphone earcup 1 is in some embodiments constructed with at least an outer casing 7 made from a high density foam material. For example in some embodiments the earcup 1 comprises an outer casing 7 which is configured to be an external supporting skeleton from which further components are located within the earcup casing 7.

In some embodiments earcup outer casing 7 is further configured to operate not only as the rear of the earcup but also comprises the cup which contacts and at least partially seals the headphone to the user ear. In some embodiments the earcup casing 7 is coupled to a second foam or other material structure which contacts the users ear.

In some embodiments the outer casing 7 is a layer or foam surrounding an internal supporting structure which further supports and locates the internal components and elements of the earcup 1.

In some embodiments the outer casing can be formed from moulded Polyurethane (PU) foams having densities at least between 15 and 70 kg/m$^3$. In some embodiments at such a density the PU foam is suitable stiff to support the earcup structurally. Furthermore at such density the air flow resistance through the foam is suitable as the cavity within the earpiece should in embodiments not be made from a foam that has very low flow resistance. It would be understood that in some embodiments a closed cell foam would be almost airtight while an open cell foam will let air through but could be suitable depending on its airflow characteristics.

An example foam which has been tested by the inventors has been the high density material Kaiflex 0.032 kg/(0.19*0.14*0.02) m=60 kg/m$^3$ as a structural element.

The use of high density foam in forming the outer casing produces in some embodiments the advantageous effect that physical impacts with the outer casing 7 are not significantly transmitted to the user. This effect can be modulated by changing the foam characteristics, rigidity, density and flow resistance to produce a suitable advantageous acoustically 'tuned' earcup. In other words the outer casing acoustically filters the impacts so that the impact noise is significantly reduced to a low level.

In some embodiments the earcup outer casing 7 as shown in FIG. 2 is configured to support or locate any internal components and interfaces within the earcup 1.

For example in some embodiments the earcup 1 further comprises a host-earcup electrical wire, cable or coupling 2. The host-earcup electrical wire 2 can be configured to transmit and receive audio data as well as any control signals that are required to be exchanged between the headset and the electronic device or host device. Although not shown the electrical wire, cable or coupling can be single or multi-core. In some embodiments the electrical wire, cable or coupling can in some embodiments further convey electrical power from the host device to the earcup 1.

In some embodiments the earcup 1 can further comprise an earcup-earcup electrical wire, cable or coupling 3. The earcup-earcup electrical wire 3 can be configured to transmit and receive audio and control signals between the earcup 1 and the other earcup not shown. It would be understood that in some embodiments where there is only one earcup per headset or the earcups are configured to operate independently the earcup-earcup electrical wire 3 can be optional.

In some embodiments the routing of the electrical wires 2 and 3 are such that the high density foam forming the outer casing 7 acts as a strain relief and as an attenuator of any acoustical waves travelling along the electrical wires. For example tugging the wires is typically known to produce low frequency waves which are transmitted to the user which in embodiments of the application can be significantly reduced by the foam characteristics.

In some embodiments the shape of the structure of the outer casing high density foam is configured with a housing cavity 4. Within the housing cavity 4 in some embodiments can be located the electronic components of the earcup contained within a housing.

In some embodiments the housing can comprise electronic circuitry and components required for the functioning of the earcup 1. For example in some embodiments the housing 4 comprises a transducer driver configured to drive the transducer 5 in such an embodiment the transducer driver can be configured to be coupled to at least part of the host-earcup electrical wire 2 to receive the electrical signals (and further the electrical power) to drive the transducer driver circuitry.

In some embodiments the housing can comprise wireless transceiver circuitry configured to receive the audio and/or control information wirelessly. For example in some embodiments a Bluetooth coupling between the earcup 1 and the electrical device or host device can be implemented. In such embodiments the host-earcup electrical wire 2 is optional as the information is passed wirelessly to the earcup. In some such embodiments the earcup-earcup electrical wire 3 can be present, especially in such embodiments where there is one wireless transceiver circuitry earcup and the other earcup is coupled to the first earcup by the earcup-earcup electrical wire.

It would be understood that there can be many different ways of configuring the earcup housing. For example the housing can in some embodiments comprise a local power source such as a battery or cell. Furthermore the housing can in some embodiments comprise signal processing circuitry.

In some embodiments the earpiece 1 further comprises a transducer 5 coupled to the housing. The transducer 5 can be any suitable transducer for example but not exclusively piezoelectric, moving coil, and electrostatic. In some embodiments the transducer 5 can be driven directly from the signal received from the electrical wires such as electrical wire 2 or 3 or in some embodiments driven by the electronics contained within the housing 4.

In some embodiments the earcup 1 further comprises a mechanical coupling configured to couple the earcup 1 mechanically to a headband support structure not shown. In the example shown in FIG. 2 the mechanical coupling is represented by shaft 6, viewed end on and running through the earcup 1. As shown in FIG. 2 the shaft 6 is only in contact with the foam of the outer casing 7. The isolating effect of the shaft being in contact only with the foam of the outer casing forces any acoustic signal transmitted through the shaft to travel through the foam before reaching the user.

Although the example embodiment shown in FIG. 2 comprises a wire or cable coupling between the headphone and the electronic apparatus whereby the headphone receives from the electrical apparatus power to operate the transducers within the earpieces to generate the acoustic sound pressure wave and also the audio signal (which in some embodiments is also the power required to generate the acoustic signal) it would be understood that in some embodiments the coupling between the headphone 101 and the electrical apparatus is wireless.

Figure 3:
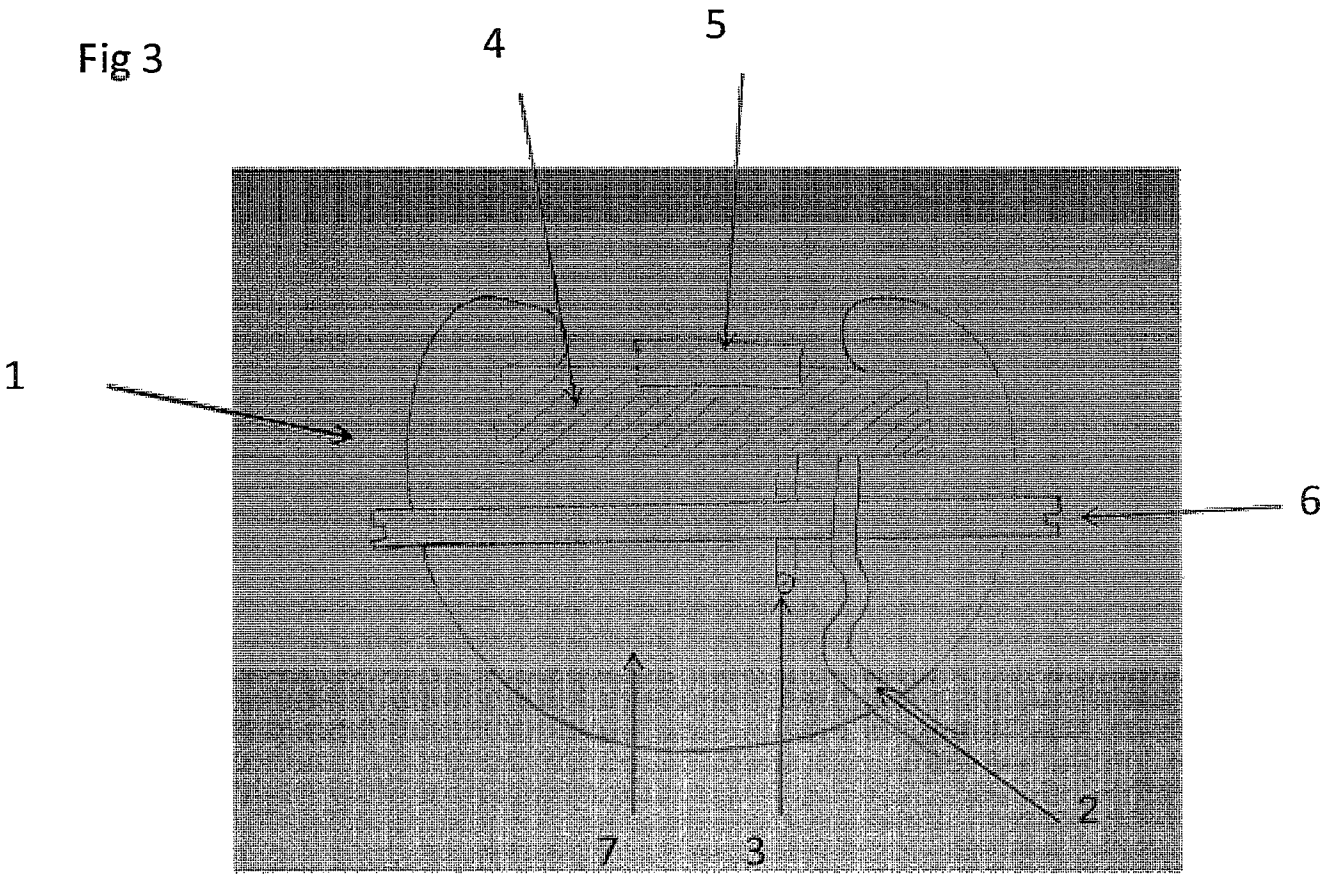
FIG. 3 illustrates a schematic top elevation cross sectional view the headphone earcup arrangement shown in FIG. 2.

With respect to FIG. 3 a plan cross sectional view of the earcup 1 shown in FIG. 2 is further shown. The earcup 1 as described herein comprises an outer casing 7 constructed from high density foam which envelopes all the other components. The host-earcup electrical wire 2 coupling the electronics within the housing and the host device and the earcup-earcup electrical wire 3 coupling the electronics within the housing 4 and the other earcup electronics are further shown from a plan view.

Similarly the housing 4 and transducer 5 are also shown. In such the embodiments shown in FIG. 2 and FIG. 3 the housing and transducer can be cylindrical in form. However the housing 4 and transducer 5 shapes can be any suitable shape or form.

The earcup 1 shaft 6 is further shown in plan view extending through the earcup coupled to the high density foam of the outer casing and suitably coupled to the supporting headband structure and pivoting the earcup enabling the earcup to worn comfortably.

In some embodiments the outer casing 7 is implemented so that at least a portion of the casing is formed from a foam material with a lower density than the high density foam material described herein.

Figure 6A:
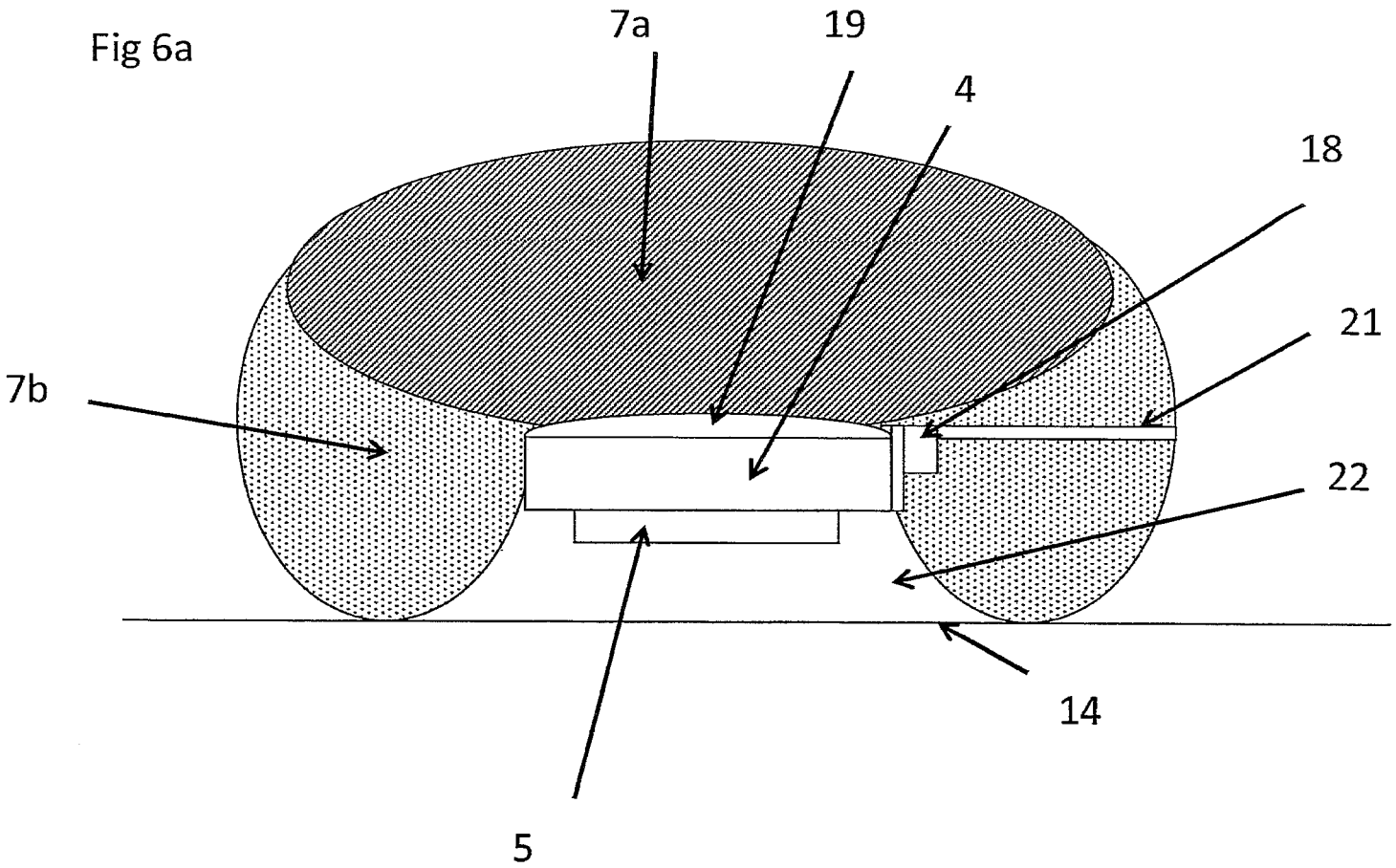
FIGS. 6*a* and 6*b* illustrate a schematic view of the headphone earcup material construction according to some embodiments of the application.
Figure 6B:
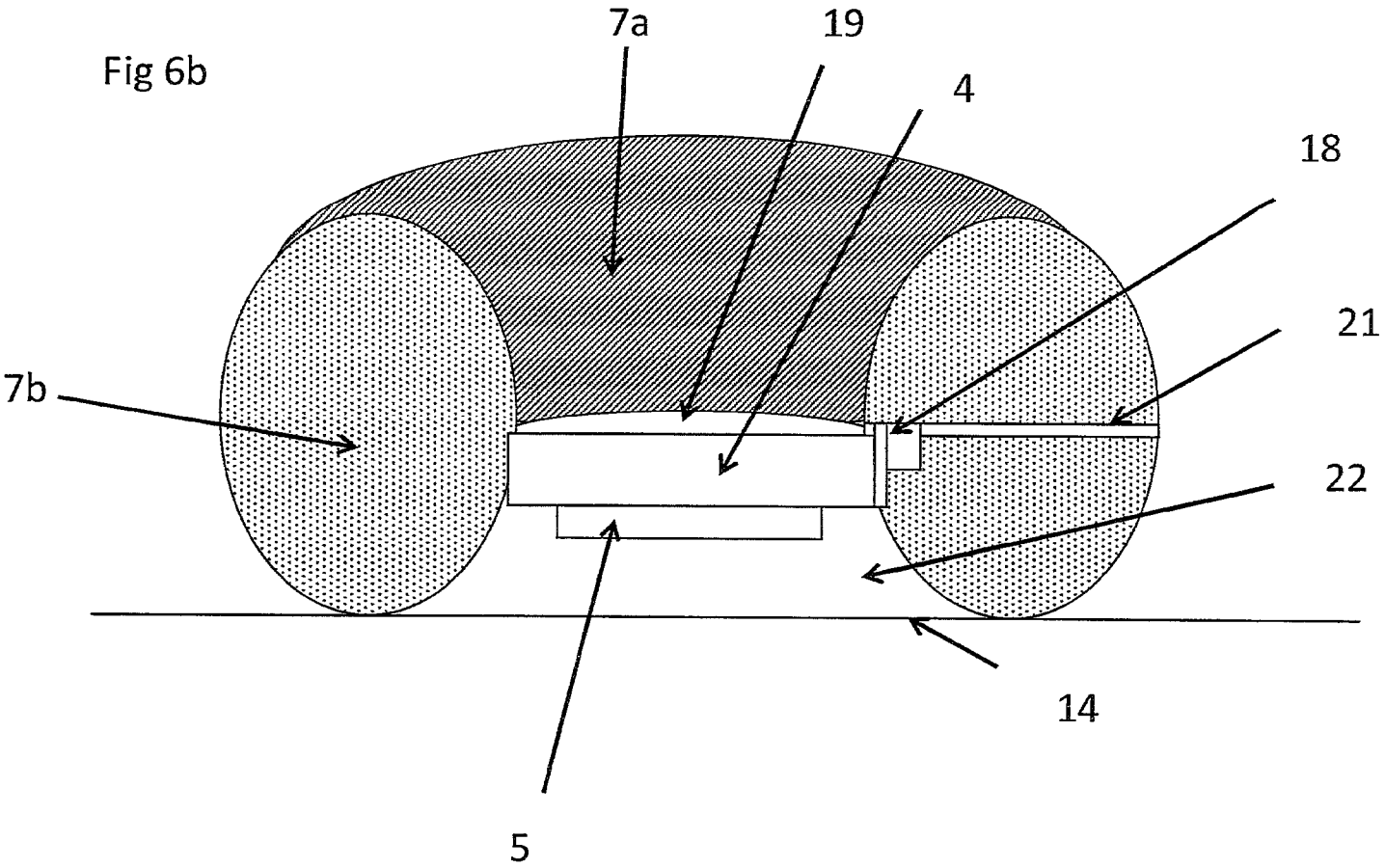

With respect to FIGS. 6*a* and 6*b* example earcups are shown with example higher and lower density foam configurations.

With respect to FIG. 6*a* the outer casing 7 can be divided into two parts. The first part of section can in some embodiments be the back or inner section 7*a* which can be configured to be formed from the high density foam as described herein and forms the earcup base, in other words the outer casing back and partially the outer casing side. The second part of section can in some embodiments be a front or outer section 7*b* which can be configured to be formed from a lower density foam structure and forms the cup lips, in other words the sides and the part of the earcup configured to contact against the surface forming the acoustic 'seal'.

It would be understood that in such embodiments the lower density foam is configured to relatively compressible compared to the harder density foam. Therefore when or if pressure is applied to the hard density foam at the back of the earcup as the earcup is pressed against a surface then the substantial proportion of distortion of the material occurs within the lower density foam. In some embodiments the lower density foam can be low-density packing foam. For example a low density foam material used by the inventors in tests has been packing foam 0.033 kg/((0.295*0.345−0.06*0.1)*0.025) m=14 kg/m$^3$. However it would be understood that in some embodiments any suitable lower density foam can be used. The foam may be an existing commercial foam, or may be specifically designed to fulfill specifications related to practical questions such as contact with skin, contamination from sweat or dust, environment-friendliness, and so on.

The location of the earcup against the ear of the user 14 can define a main acoustic cavity 22. The main cavity 22 can be substantially defined by the volume between the transducer 5 and housing 4, the outer casing 7 and the listening surface 14.

In some embodiments there can be a rear or sensing cavity 19 between the inner surface of the outer casing 7 and the housing 4.

In some embodiments the lower density foam is moulded to form a small cavity 18 which couples the main acoustic cavity 22, the sensing or rear cavity 19 and a conduit 21. The conduit 21 is configured to couple the small cavity 18 to the exterior of the earcup.

In some embodiments it would be understood that the small cavity 18 and any conduits to the sensing cavity, acoustic cavity and exterior can in some embodiments be formed as part of the high density foam structure.

With respect to FIG. 6*b* a further example of an earcup is shown. The earcup shown in FIG. 6*b* differs from the earcup shown in FIG. 6*a* in that a greater proportion of the earcup outer casing is implemented as lower density foam providing a more compliant and comfortable wearing surface at potentially a lowering of the structural rigidity of the earcup. It would be understood that the proportions and/or the arrangement of high and lower density foam structures can be any suitable structure and the design of which can be a balance between earcup comfort, structural rigidity and acoustic performance.

Figure 4:
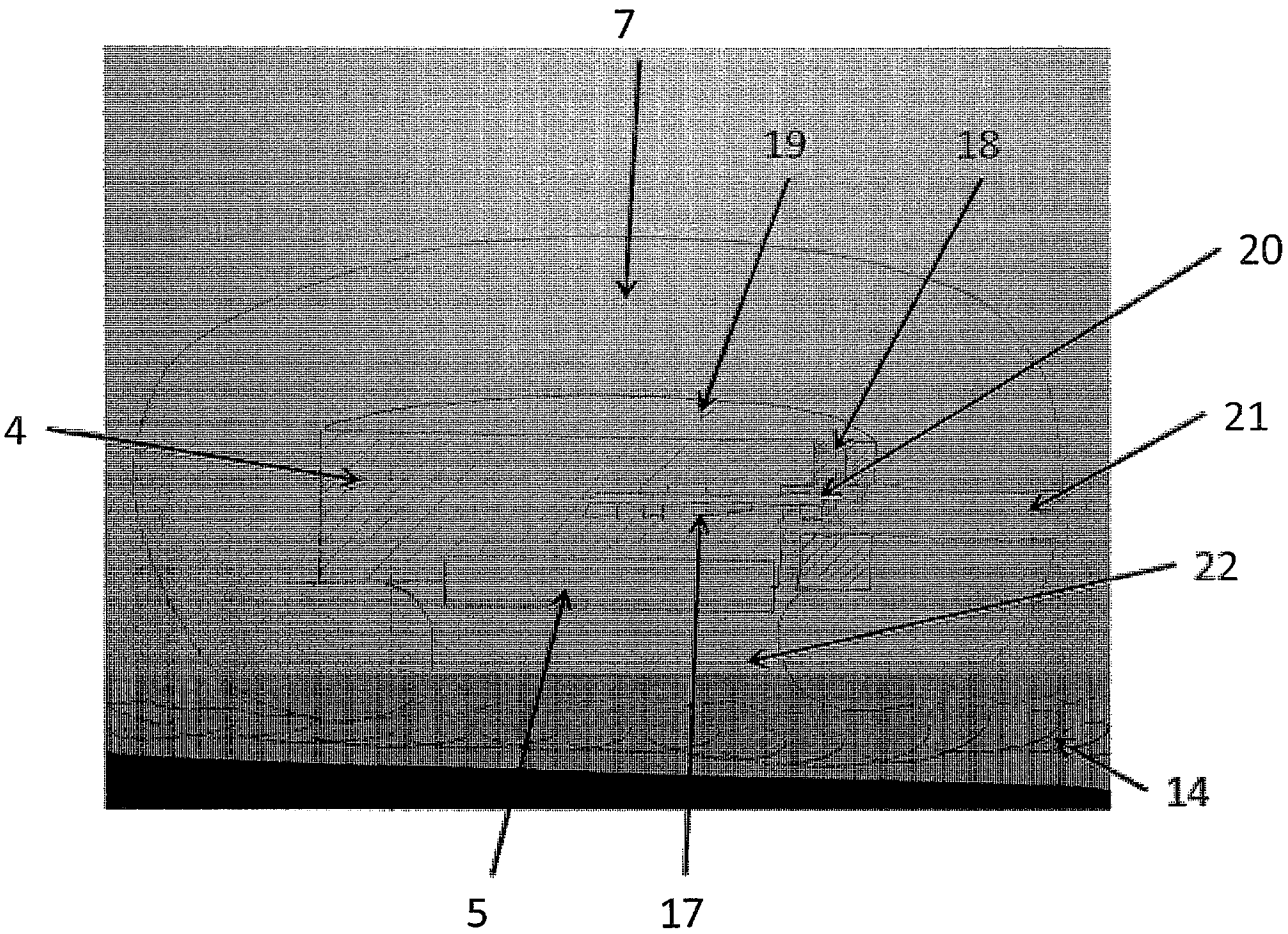
FIG. 4 illustrates a schematic view within the headphone earcup arrangement shown in FIGS. 2 and 3.

With respect to FIG. 4 a further example of an earcup is shown. The earcup 1 in FIG. 4 is shown located against the listening surface 14, such as the ear of the user. The location of the earcup 1 against the ear of the user 14 can define the main acoustic cavity 22. The main cavity 22 can be substantially be defined by the volume between the transducer 5 and housing 4, the outer casing 7 and the listening surface 14.

The housing 4 which physically/mechanically locates the transducer 5 within the outer casing 7 can in some embodiments comprise the electrical circuitry for operating the earcup 1. The electrical circuitry is shown in FIG. 4 located on the electrical circuit board 17 within the housing 4.

In some embodiments there can be a rear or sensing cavity 19 between the inner surface of the outer casing 7 and the housing 4.

In the example shown in FIG. 4, the small cavity 18 is formed not within the lower density foam part of the outer casing 7 but is moulded or machined as part of the housing 4. The small cavity 18 as described herein couples the main acoustic cavity 22, the sensing or rear cavity 19 and the conduit 21 is configured to couple the small cavity 18 to the exterior of the earcup.

The small cavity can in some embodiments can have a practical volume of a few mm$^3$ or greater.

In some embodiments located within small cavity 18 is a sensing element 20. In some embodiments the sensing element 20 is a microphone which is mechanically and electrically coupled to the electrical circuit board 17 embedded within the housing 4. The construction of the small cavity 18 is configured such that small volumes of air moving through the housing cavity generate turbulent vibrations which are detected by the sensing element 20.

It would be understood that in some embodiments the sensing element 20 can be any suitable air flow sensor. For example in some embodiments the sensing element 20 can comprise a heated wire and a temperature sensor, for example a variometer. In such embodiments the sensing element detects any air flow by a temperature difference as the heated wire in the air flow warms the moving air which is detected by the temperature sensor (variometer). It would be understood that the heated wire and variometers can be implemented in some embodiments within a MEMS (micro-electro-mechanical system).

In some embodiments the sensing element 20 can be further implemented as a MEMS cantilever arrangement where the change of the shape of the cantilever due to the air flow can be measured, a vibrator where the frequency of vibration changes with the flow due to differential or absolute pressure can be measured.

It would be understood that in some embodiments not only can air flow be detected but the directionality and density of the air flow can be determined by the sensing element 20.

It should be noted that in some embodiments the small cavity 18 and any conduits or tubing connecting the cavity to the sensing element 20 can be integrated as shown in FIGS. 6*a* and 6*b* where the small cavity 18 and conduits are formed as part of the outer casing. Furthermore in some embodiments where the small cavity or conduits are formed in the lower density foam material the volume of the cavity and/or conduit/tubing can also change when pressure is experienced by the small cavity. Furthermore in some embodiments within a very small dimensioned housing cavity 18 design flow choking can limit the flow and furthermore any manufacturing tolerances can affect the air flow at some point. However it would be understood that the sensing element configured to measure very tiny flows can be miniaturized.

In such embodiments the change of cavity volume can also be measured directly by the sensing element 20. For example, in some embodiments the sensing element 20 can comprise an electrostatic sensor configured to measure the volume change of the cavity electrostatically. In some other embodiments the sensing element comprises a light detector configured to measure the change in light absorption as the volume of the cavity changes. Furthermore in some embodiments the sensing element can comprise an ultrasound sensor configured to determine any volume change due to pressure either absolute or relative.

In some embodiments the sensing element 20 is configured to determine from which direction the air is moving through the small cavity. For example in some embodiments the small cavity 18 and conduits can be designed to have unsymmetrical air flow patterns which cause turbulent flow with different resonances dependent on whether the air is moving from the rear or sensing cavity 19 to the acoustic cavity 22 or vice versa, from the sensing cavity 19 to the exterior of the headset or vice versa, or from the main acoustic cavity 22 to the exterior of the headphone or vice versa.

In some embodiments the vibrations can be detected and/or the direction of the air flow determined and/or the volume of the cavity within the sensing element 20 and the output of the sensing element 20 in the form of information signals can be passed to the electrical circuit board 17.

In some embodiments the electrical circuit board 17 comprises processing elements, such as a digital signal processor configured to process the detected vibrations. However it would be understood that in some embodiments the earcups are 'dumb' devices and the sensing element 20 output is passed via the electrical wire 2 to the host device to be processed at the host device or elsewhere.

It would be understood that in some embodiments the outer casing can be considered to be a housing for the other elements or components of the earcup. Furthermore in some embodiments the housing can comprise a cavity constructed from the relatively compressible lower density foam and coupled to the exterior of the earcup. Within the cavity can be located the sensing element configured to detect air flow through the cavity as described herein when the outer casing is experiencing a higher than ambient pressure on the earcup as the cavity is compressed.

Figure 5:
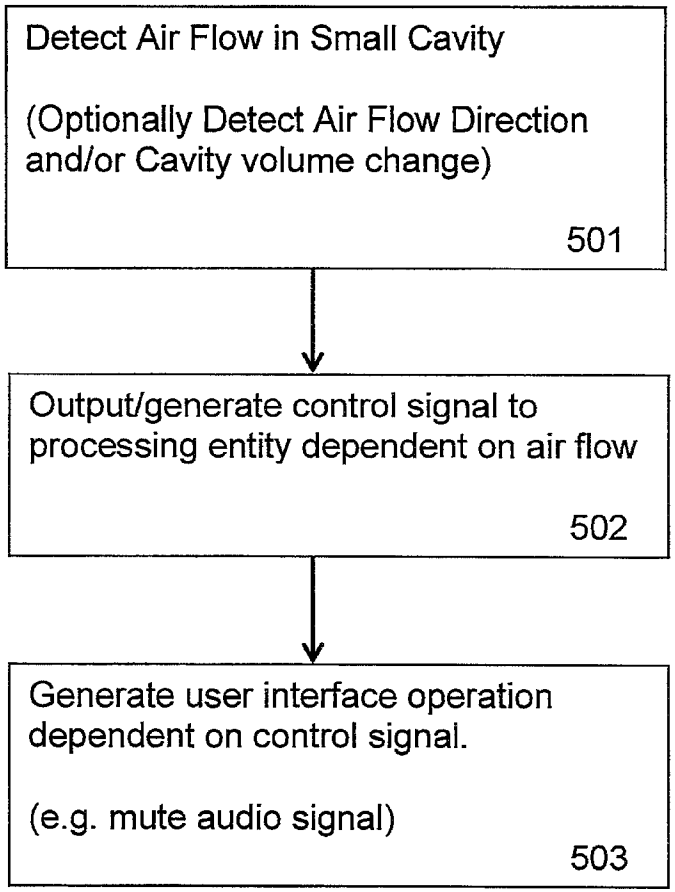
FIG. 5 illustrates a flow diagram showing the operation of the headphone earcup according to some embodiments.

With regards to FIG. 5, the operation of detecting the air flow and the processing of the air flow with respect to turbulent flow vibration detected by microphones is described.

With respect to FIG. 5 the sensing element 20 can determine a pressure change in terms of an air flow from the sensing cavity 19. This can for example be caused by pressure on the outer casing foam causing compression of the lower density foam and/or sensing cavity causing a change of the differential pressure between the sensing cavity 19 and at least one of the main acoustic cavity or the exterior of the earcup. This for example can be performed by the user of the headphone pressing firmly on the headphone.

The detection of the pressure change is shown in FIG. 5 by step 501.

The sensing element 20 can then pass the information signal to a processing entity such as found either on the electrical circuit board 17, within the host device, or elsewhere.

The processing entity can then in some embodiments generate a control signal dependent on the information signal. For example where the air flow is greater than a determined threshold a control signal can be generated and output.

The generation of a control signal is shown in FIG. 5 by step 502.

The processing entity can in some embodiments process the pressure change as an user interface input from the earcup based on the control signal. For example in some embodiments the pressing of the earcup can switch the host device on or off, mute the audio signal, provide a volume boost, or any other suitable user interface input.

Although the above example describes a binary user interface input it would be understood that in some embodiments the user interface input can be a variable input dependent on the pressure change and/or the duration of the pressure change. Furthermore where both earcups are configured with user interface capability the pressure change of each earcup can be configured in some embodiments to generate different user interface operations. Similarly where both earcups are configured with user interface capability the pressure change of both earcup substantially at the same time or one relative to the other can be configured to generate different user interface operations.

In some embodiments it would be understood that the processing of the user interface input can be configured by the host device or be fixed or hardwired during the headphone construction. For example in some embodiments where the transducer 5 is configured to output an audio signal/track being played back by the headphones, then the processor can process the audio signal such to mute the audio output on detection of pressure on the earcup.

The operation of performing a user interface operation dependent on the sensing element output/control signal is shown in FIG. 5 by step 503.

It would be understood that in some embodiments the sensing element, being "open" to vibrations from outside of the earpiece could double as a microphone for a headset and as the input audio signal conduit where the foam structural doubles as a windscreen preventing wind.

It shall be appreciated that the host apparatus or device can be any suitable portable apparatus and in some embodiments is user equipment. The user equipment is intended to cover any suitable type of wireless user equipment, such as mobile telephones, portable data processing apparatus or portable web browsers.

Furthermore, it will be understood that the term acoustic sound channels is intended to cover sound outlets, channels and cavities, and that such sound channels may be formed integrally with the transducer, or as part of the mechanical integration of the transducer with the apparatus.

In general, the various embodiments may be implemented in hardware or special purpose circuits, software, logic or any combination thereof. Some aspects of the application may be implemented in hardware, while other aspects may be implemented in firmware or software which may be executed by a controller, microprocessor or other computing apparatus, although the application is not limited thereto. While various aspects of the application may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or controller or other computing apparatus, or some combination thereof.

The embodiments of this application may be implemented by computer software executable by a data processor of the mobile apparatus, such as in the processor entity, or by hardware, or by a combination of software and hardware.

For example, in some embodiments the method of manufacturing the apparatus may be implemented with processor executing a computer program.

Further in this regard it should be noted that any blocks of the logic flow as in the Figures may represent program steps, or interconnected logic circuits, blocks and functions, or a combination of program steps and logic circuits, blocks and functions. The software may be stored on such physical media as memory chips, or memory blocks implemented within the processor, magnetic media such as hard disk or floppy disks, and optical media such as for example DVD and the data variants thereof, CD.

The memory may be of any type suitable to the local technical environment and may be implemented using any suitable data storage technology, such as semiconductor-based memory devices, magnetic memory devices and systems, optical memory devices and systems, fixed memory and removable memory. The data processors may be of any type suitable to the local technical environment, and may include one or more of general purpose computers, special purpose computers, microprocessors, digital signal processors (DSPs), application specific integrated circuits (ASIC), gate level circuits and processors based on multi-core processor architecture, as non-limiting examples.

Embodiments of the applications may be practiced in various components such as integrated circuit modules. The design of integrated circuits is by and large a highly automated process. Complex and powerful software tools are available for converting a logic level design into a semiconductor circuit design ready to be etched and formed on a semiconductor substrate.

Programs, such as those provided by Synopsys, Inc. of Mountain View, Calif. and Cadence Design, of San Jose, Calif. automatically route conductors and locate components on a semiconductor chip using well established rules of design as well as libraries of pre-stored design modules. Once the design for a semiconductor circuit has been completed, the resultant design, in a standardized electronic format (e.g., Opus, GDSII, or the like) may be transmitted to a semiconductor fabrication facility or "fab" for fabrication.

As used in this application, the term 'circuitry' refers to all of the following:

(a) hardware-only circuit implementations (such as implementations in only analog and/or digital circuitry) and (b) to combinations of circuits and software (and/or firmware), such as: (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of 'circuitry' applies to all uses of this term in this application, including any claims. As a further example, as used in this application, the term 'circuitry' would also cover an implementation of merely a processor (or multiple processors) or portion of a processor and its (or their) accompanying software and/or firmware. The term 'circuitry' would also cover, for example and if applicable to the particular claim element, a baseband integrated circuit or applications processor integrated circuit for a mobile phone or similar integrated circuit in server, a cellular network device, or other network device.

The foregoing description has provided by way of exemplary and non-limiting examples a full and informative description of the exemplary embodiment of this application. However, various modifications and adaptations may become apparent to those skilled in the relevant arts in view of the foregoing description, when read in conjunction with the accompanying drawings and the appended claims. However, all such and similar modifications of the teachings of this application will still fall within the scope of this application as defined in the appended claims. Indeed there is a further embodiment comprising a combination of one or more of any of the other embodiments previously discussed.

The invention claimed is:

1. An apparatus comprising:

a housing comprising a speaker for generating sound waves; and a sensing element for detecting air movement in the housing and further providing a control signal based on a detected air movement, wherein the housing comprises at least a first portion configured with a compressible material, where the compressible material is coupled to the sensing element such that air movement in the housing is detected by the sensing element when the compressible material is compressed with the sensing element configured to provide the control signal in response to detection of the air movement caused by compression of the compressible material that serves as a user interface input with the control signal configured to cause processing of an audio signal being played by the speaker for generating sound waves.

2. The apparatus as claimed in claim 1, further comprising sending the control signal to a host apparatus.

3. The apparatus as claimed in claim 1, further comprising a controller configured to receive the control signal.

4. The apparatus as claimed in claim 1, further configured to perform a user interface operation dependent on the control signal.

5. The apparatus as claimed in claim 4, wherein the user interface operation comprises at least one of:

filtering an input audio signal for the speaker;

muting an input audio signal for the speaker;

switching off a host apparatus; and amplifying an input audio signal for the speaker.

6. The apparatus as claimed in claim 1, wherein the housing is at least partially constructed from a high density foam configured to provide passive attenuation of sound from the surrounding environment.

7. The apparatus as claimed in claim 6, wherein the high density foam has a density of 60 kg/m$^3$.

8. The apparatus as claimed in claim 1, wherein the housing comprises a first cavity wherein the sensing element is located within the first cavity and configured to detect air movement in the first cavity.

9. The apparatus as claimed in claim 8, wherein the first cavity defines a compressible air volume, such that the change in air volume creates air movement in the first cavity when compressed.

10. The apparatus as claimed in claim 8, wherein the housing comprises at least one further cavity coupled to the first cavity, wherein the at least one further cavity defines a compressible air volume and creates air movement in the first cavity when the at least one further cavity is compressed.

11. The apparatus as claimed in claim 8, wherein the housing further comprises a leakage conduit is configured to couple the first cavity to the exterior of the apparatus.

12. The apparatus as claimed in claim 1, wherein the sensing element comprises at least one of:

a microphone;

a heated wire and temperature sensor;

a cantilever; and a micro-electro-mechanical system.

13. The apparatus as claimed in claim 1, wherein the apparatus comprises at least one of:

headphones;

headset;

earphones;

earbuds; and earcups.

14. The apparatus as claimed in claim 1, wherein the compressible material is a packing foam.

15. The apparatus as claimed in claim 1, wherein the control signal is configured to control a host apparatus including a transmission of audio data and control signals between the apparatus and the host apparatus.

16. The apparatus as claimed in claim 1, wherein the audio signal being played by the speaker is provided by a host apparatus.

17. The apparatus as claimed in claim 1, wherein the audio signal being played by the speaker is provided via wired or wireless connectivity.

18. An apparatus comprising:

a housing comprising a speaker for generating sound waves wherein the housing comprises a first cavity; and a sensing element for detecting air movement in the housing and further providing a control signal based on a detected air movement, wherein the housing comprises at least a first portion configured with a compressible material, where the compressible material is coupled to the sensing element such that air movement in the housing is detected by the sensing element when the compressible material is compressed, wherein the sensing element is located within the first cavity and configured to detect air movement in the first cavity, and wherein the first cavity is configured to generate turbulent air flow movement.

19. An apparatus comprising:

a housing comprising a speaker for generating sound waves; and a sensing element for detecting air movement in the housing and further providing a control signal based on a detected air movement, wherein the housing comprises at least a first portion configured with a compressible material, where the compressible material is coupled to the sensing element such that air movement in the housing is detected by the sensing element when the compressible material is compressed, wherein the sensing element is configured to determine at least one of:

a direction of the air movement in the housing; or a speed of the air movement in the housing.

20. A method comprising:

providing a housing comprising a speaker for generating sound waves;

providing a compressible material within a first portion of the housing;

locating a sensing element within the housing;

detecting air movement within the housing by the sensing element when the compressible material is displaced; and providing a control signal based on the detected air movement that serves as a user interface input configured to cause processing of an audio signal being played by the speaker for generating sound waves.

21. The method as claimed in claim 20, further comprising at least one of:

sending the control signal to a host apparatus;

providing the control signal to a controller; and performing a user interface operation dependent on the control signal.

22. The method as claimed in claim 21, wherein performing the user interface operation comprises at least one of:

filtering an input audio signal for the speaker;

muting an input audio signal for the speaker;

switching off a host apparatus; and amplifying an input audio signal for the speaker.

23. The method as claimed in claim 20, wherein detecting air movement in the housing comprises at least one of:

determining the direction of the air movement in the housing; and determining the speed of the air movement in the housing.

24. The method as claimed in claim 20, wherein the control signal is configured to control a host apparatus including a transmission of audio data and control signals between the apparatus and the host apparatus.

25. The method as claimed in claim 20, wherein the audio signal being played by the speaker is provided by a host apparatus.

26. The method as claimed in claim 20, wherein the audio signal being played by the speaker is provided via wired or wireless connectivity.

* * * * *